US007942216B2

(12) United States Patent
Hisada et al.

(10) Patent No.: US 7,942,216 B2
(45) Date of Patent: May 17, 2011

(54) DRILL ROD, DRILL BIT, AND DRILLING TOOL

(75) Inventors: Masaya Hisada, Gifu-Ken (JP); Masahiro Koizumi, Gunman-Ken (JP); Takashi Suzuki, Nagoya (JP)

(73) Assignees: Mitsubishi Materials Corporation, Tokyo (JP); Furukawa Rock Drill Co., Ltd., Tokyo (JP)

( * ) Notice: Subject to any disclaimer, the term of this patent is extended or adjusted under 35 U.S.C. 154(b) by 367 days.

(21) Appl. No.: 12/092,134

(22) PCT Filed: Nov. 21, 2006

(86) PCT No.: PCT/JP2006/323191

§ 371 (c)(1),
(2), (4) Date: Apr. 30, 2008

(87) PCT Pub. No.: WO2007/066508

PCT Pub. Date: Jun. 14, 2007

(65) Prior Publication Data

US 2009/0260892 A1 Oct. 22, 2009

(30) Foreign Application Priority Data

Dec. 9, 2005 (JP) ..... 2005-355888

(51) Int. Cl.
*E21B 17/042* (2006.01)
*E21B 17/04* (2006.01)

(52) U.S. Cl. ..... 175/320; 175/414

(58) Field of Classification Search ..... 175/320, 175/420, 428, 394, 171, 414; 411/411, 436, 411/426, 336.1
See application file for complete search history.

(56) References Cited

U.S. PATENT DOCUMENTS

| | | | |
|---|---|---|---|
| 4,796,923 | A | 1/1989 | Liggins et al. |
| 5,794,728 | A | 8/1998 | Palmberg |
| 2002/0074797 | A1 | 6/2002 | Liljebrand et al. |
| 2004/0050592 | A1 | 3/2004 | Carlstrom et al. |

FOREIGN PATENT DOCUMENTS

| | | | |
|---|---|---|---|
| JP | 63-047588 | | 2/1988 |
| JP | 2005-530944 | | 10/2005 |
| RU | 2155852 | C2 | 9/2000 |
| RU | 2204684 | C2 | 5/2003 |
| RU | 2231615 | C2 | 6/2004 |
| SE | 517151 | C2 | 4/2002 |
| SE | 520036 | C2 | 5/2003 |
| SU | 179714 | A1 | 11/1966 |
| WO | 8203653 | A1 | 10/1982 |
| WO | 00/19056 | | 4/2000 |
| WO | 03042493 | A1 | 5/2003 |

*Primary Examiner* — Shane Bomar
*Assistant Examiner* — Brad Harcourt
(74) *Attorney, Agent, or Firm* — Leason Ellis LLP.

(57) ABSTRACT

A drill rod has a fitting portion protruding toward the distal end of the drill rod. The drill rod fitting portion further encompasses a parallel male thread portion in which a minimum distance from a first axial line in a cross-section perpendicular to the first axial line is constant; and a male thread ending portion is continuous with a proximal end of the parallel male thread portion. The minimum distance of the ending portion increases as a proximal end is approached. Furthermore, the fitting portion is formed such that the minimum distance does not decrease as the proximal end is approached from a distal end thereof. Additionally, the proximal end of the male thread ending portion is positioned where a distance from the first axial line gradually increases as the proximal end of the male thread ending portion is approached from the parallel male thread.

8 Claims, 6 Drawing Sheets

DRILL ROD, DRILL BIT, AND DRILLING TOOL

CROSS REFERENCE TO PRIOR APPLICATION

This is a U.S. National Phase Application under 35 U.S.C. §371 of International Patent Application No. PCT/JP2006/323191 filed on Nov. 21, 2006, which claims the benefit of Japanese Patent Application No. 2005-355888 filed on Dec. 9, 2005, both of which are incorporated by reference herein. The International Application was published in Japanese on Jun. 14, 2007 as WO 2007/066508 A1 under PCT Article 21(2).

TECHNICAL FIELD

The present invention relates to a drill rod, a drill bit, and a drilling tool, used for drilling through the ground and sediment, in tunnel excavation and other civil engineering, in various construction tasks to install anchors, foundation piles and the like, or in stone-crushing operations.

BACKGROUND ART

As drilling tools used to drill into the ground, through sediment, and into the materials to be drilled, the drilling tools made up of drill bits having a plurality of button tips formed from cemented carbide and other hard materials, and drill rods to support the drill bits, are used. At the proximal end of a drill bit is formed a fitting hole having a female thread on the inner peripheral face. On the distal of a drill rod is provided a fitting portion having a male thread on the outer peripheral face. In a drill tool, a drill rod and a drill bit are formed into an integral unit by screwing the male thread of the fitting portion of the drill rod with the female thread of the fitting hole of the drill bit.

In recent years, demand for high-speed drilling execution has lead to requires for greater efficiency of drilling tasks through enhanced drilling equipment performance and increased drilling speed. However, using conventional drilling tools, the diameter of the fitting portion of drill rods is small in order to secure an adequate wall thickness for drill bits, so that when mounting such a drilling tool on drilling equipment and drilling through ground or similar, the load on the drilling tool is increased when the drilling speed is raised, and there are concerns that this load may cause damage to the drill rod. On the other hand, when the drill rod diameter is increased, the wall thickness of the drill bit is reduced, and so there is the problem that the drill bit may be damaged. In particular, when the drill rod breaks, the drill bit or similar remains at the bottom of the drilled hole, so that recovery entails considerable time and effort, which is uneconomical. As a result, there have been strong demands for improved rigidity of drill rods.

In Japanese Patent Document 1, an invention is proposed in which, by forming the fitting portion of a drill rod in a taper shape and using taper-shape threads for screwing, the wall thickness of the drill bit on the distal side of the drilling tool can be secured, while increasing the diameter of the drill rod on the drilling tool proximal side, at which the bending stress applied to the drill rod becomes large, so that rigidity of the drill rod and the drill bit are improved, and damage to the drilling tool due to the load is prevented.

[Patent Document 1] PCT International Publication No. WO 00/19056

However, in the case of the drilling tool disclosed in Patent Document 1, because the fitting portion is formed in a taper shape and screwing is performed using threads in a taper shape, there are concerns that shocks during drilling may cause the drill bit easily to be separated from the drill rod. Further, machining to form a taper-shape thread is difficult, and so there is the problem that the cost of manufacturing such drill rods and drill bits is increased.

Also, because a relief portion is formed in the distal end of a drill bit, that is, in the hole bottom portion of the fitting hole, in order to cut the female thread, a thin-wall portion is formed on the distal side of the drill bit, despite forming a taper-shape thread, and so there are concerns that the load on the drilling tool may cause damage to the drill bit.

DISCLOSURE OF THE INVENTION

This invention is devised in light of the above-described circumstances, and has as an object to provide a drill rod, a drill bit, and a drilling tool, which, by securing rigidity of the drill rod and the drill bit, enable efficient performance of drilling tasks at increased drilling speeds, without easy separation of the drill bit from the drill rod due to shocks during drilling.

In order to achieve the above-described object, a drill rod of the present invention has a fitting portion which protrudes toward a distal end of the drill rod and extends along a first axial line, wherein the fitting portion includes: a parallel male thread portion in which a minimum distance from the first axial line in a cross-section perpendicular to the first axial line is constant; and a male thread ending portion which is continuous with a proximal end of the parallel male thread portion, and in which the minimum distance from the first axial line increases as approaching toward the proximal end thereof, wherein the fitting portion is formed such that the minimum distance does not decrease as approaching from the distal end to the proximal end thereof; and the proximal end of the male thread ending portion is positioned on a face where a distance from the first axial line gradually increases as approaching from the parallel male thread to the proximal end portion.

A drill bit of the present invention has a fitting hole which is opened toward a proximal end and extends along a second axial line, wherein the fitting hole includes: a parallel female thread portion in which a maximum distance from the second axial line in a cross-section perpendicular to the second axial line is constant; and a female thread ending portion which is continuous with a distal end of the parallel female thread portion, in which the maximum distance from the second axial line in a cross-section perpendicular to the second axial line decreases as approaching toward the distal end thereof; the fitting hole is formed such that the maximum distance does not decrease as approaching from the distal end toward the proximal end thereof; and the distal end of the female thread ending portion is positioned on a face where the distance from the second axial line is smaller than that for the parallel female thread portion.

A drilling tool of the present invention has the above-described drill rod and the above-described drill bit, and is configured by screwing the parallel male thread portion of the drill rod with the parallel female thread portion of the drill bit.

According to the drill rod of the present invention, since the drill rod has the fitting portion formed such that the minimum distance from the first axial line in a cross-section perpendicular to the first axial line is not smaller on the proximal end side compared with the distal end side; therefore, high rigidity can be secured in the proximal end portion in which the bending stress exerted on the drill rod is high; and in addition, there is no relief portion having smaller diameter midway in the fitting portion, so that breakage of the drill rod can be suppressed.

Further, in the drill rod, the male thread ending portion which is not screwed with the female thread is positioned on a face where the distance from the first axial line increases gradually as approaching from the parallel male thread portion toward the proximal end side, so that high rigidity in the male thread ending portion can be secured.

Further, in the drill rod, a parallel male thread portion is formed, so that even when a force acts to cause separation of the drill bit and the drill rod due to shocks during drilling, separation of the drill bit can be prevented. Further, production of the male thread is easy, and the drill rod can be manufactured at low cost.

In the drill rod, it is preferable that a radius of curvature of a thread groove portion in the male thread ending portion in a cross-section containing the first axial line be formed to be larger than a radius of curvature of a thread groove portion of the mal thread formed in the parallel male thread portion in a cross-section containing the first axial line. In this case, a cutout portion in the male thread ending portion can be made small, and rigidity of the drill rod can be reliably increased.

In this drill rod, it is preferable that a length of the male thread ending portion along the first axial line direction be equal to or less than a thread pitch P of the parallel male thread portion. In this case, the male thread ending portion which does not contribute to screwing of threads is not long unnecessarily; and the rigidity of the drill rod can be further improved.

In this drill rod, it is preferable that a length of the fitting portion from the distal end face of the fitting portion to the proximal end of the parallel male thread portion along the first axial line direction be 2.5×D or less, where D is a minor diameter of the parallel male thread portion. In this case, the magnitude of the bending stress load on the thread groove portion at the proximal end of the parallel male thread portion can be suppressed, and breakage of the parallel male thread portion can be prevented.

Further, in this drill rod it is preferable that a length of the parallel male thread portion along the first axial line direction be 3.8×P or greater, where P is a thread pitch of the parallel male thread portion. In this case, the necessary number of thread ridges in the parallel male thread portion can be secured. Hence the load acting on each thread ridge can be suppressed, so that early wearing of threads in the parallel male thread portion and concentrated stress due to the tightening torque can be distributed, and the drill rod lifetime can be extended.

According to the drill bit of the present invention described above, the fitting hole is formed such that the maximum distance from the second axial line in the cross-section perpendicular to the second axial line does not become small on the proximal end side compared with the distal end side, so that sufficient wall thickness can be secured in the distal end portion in which shocks are exerted on the drill bit, and the drill bit rigidity can be improved. Further, there is no relief portion in which the wall thickness becomes small midway in the fitting hole, so that damage to the drill bit can be suppressed.

Further, the female thread ending portion which does not screw with the male thread is positioned on a face where the distance from the second axial line is reduced compared with the parallel female thread portion, so that an adequate wall thickness at the female thread ending portion can be secured, and rigidity can be improved.

Further, the parallel female thread portion is formed, so that even when a force acts to separate the drill bit and the drill rod due to shocks during drilling, the drill bit and the drill rod can be prevented from separating; and moreover, the female thread can be easily formed, and the drill bit can be manufactured at low cost.

In this drill bit, it is preferable that a radius of curvature of a thread groove portion in a cross-section containing the second axial line in the female thread ending portion be larger than a radius of curvature of a thread ridge portion in a cross-section containing the second axial line of the female threads formed in the parallel female thread portion. In this case, the wall thickness in the female thread ending portion can be made thick, and the drill bit rigidity can be reliably improved.

In this drill bit, it is preferable that a length of the female thread ending portion along the second axial line direction be equal to or less than a thread pitch P of the parallel female thread portion. In this case, the female thread ending portion which does not contribute to screwing of threads is not long unnecessarily, and the rigidity of the drill bit can be further improved.

According to the above-described drilling tool of the present invention, since the drill rod and the drill bit having the rigidity as above-described are screwed together, damage to the drill bit due to the load exerted on the drilling tool can be prevented; and moreover, breakage of the drill rod due to bending stress can be prevented. Hence a drilling tool can be provided for which the drilling speed can be raised, and drilling tasks can be performed efficiently.

In the drilling tool, it is preferable that, in the state in which the drill rod and the drill bit are screwed together, the distance between the distal end of the parallel male thread portion and the proximal end of the female thread ending portion along the first axial line direction be made larger than the distance between the distal end of the male thread ending portion and the proximal end of the parallel female thread portion along the first axial line direction. In this case, indentation of the proximal end portion of the parallel female thread of the drill bit with the male thread ending portion occurs preferentially over indentation of the distal end portion of the parallel male thread portion of the drill rod with the female thread ending portion. Hence indentation occurs in the vicinity of the opening portion of the fitting hole, and separation and other treatment of the drill bit and the drill rod.

Drill bits are directly contact with materials to be drilled such as base rocks; therefore the lifetimes are shorter than the drill rods. Therefore, by indenting the threads in advance at the parallel female thread portion of the drill bit, the indentation at the parallel male thread portion of the drill rod can be prevented, so that the lifetime of the drill rod can be extended. In order to success the above effects further reliably, it is preferable that hardness of the drill rod be set hither than that of the drill bit. More specifically, it is preferable that a difference of the hardness between the drill bit and the drill rod be equal to or larger than 6 points in HRC (i.e., C-scale in Rockwell hardness scale).

In this drilling tool, it is preferable that there be a first inclined face formed on the proximal end of the fitting portion of the drill rod in which the distance from the first axial line in a cross-section perpendicular to the first axial line gradually increases as approaching toward the proximal end, and that there be a second inclined face formed on the proximal end portion of the fitting hole of the drill bit in which the distance from the second axial line in a cross-section perpendicular to the second axial line gradually increases as approaching toward the proximal end; and it is preferable that, when the first axial line of the fitting portion and the second axial line of the fitting hole coincide, the first inclined face and the second inclined face be separated, and that, when the first axial line and the second axial line are displaced so as not to coincide, the first inclined face and the second inclined face be in mutual contact. In this case, when bending stress is exerted on the drill rod so that there is displacement such that the first axial line of the drill rod does not coincide with the second axial line of the drill bit, the first inclined face and the second inclined face are in contact, and the bending stress can be received at the portion of the drill rod on the proximal end side where the diameter is large and the rigidity is high, so that breakage of the drill rod and damage to the thread caused by the bending stress can be reliably prevented.

According to the present invention, a drill rod, a drill bit, and a drilling tool can be provided such that, by securing high rigidity in a drill rod and a drill bit, the drilling speed can be raised and drilling tasks can be performed efficiently, and moreover, separation of the drill bit and the drill rod due to shocks at the time of drilling cannot easily occur.

BRIEF DESCRIPTION OF THE REFERENCE SYMBOLS

Figure 1:
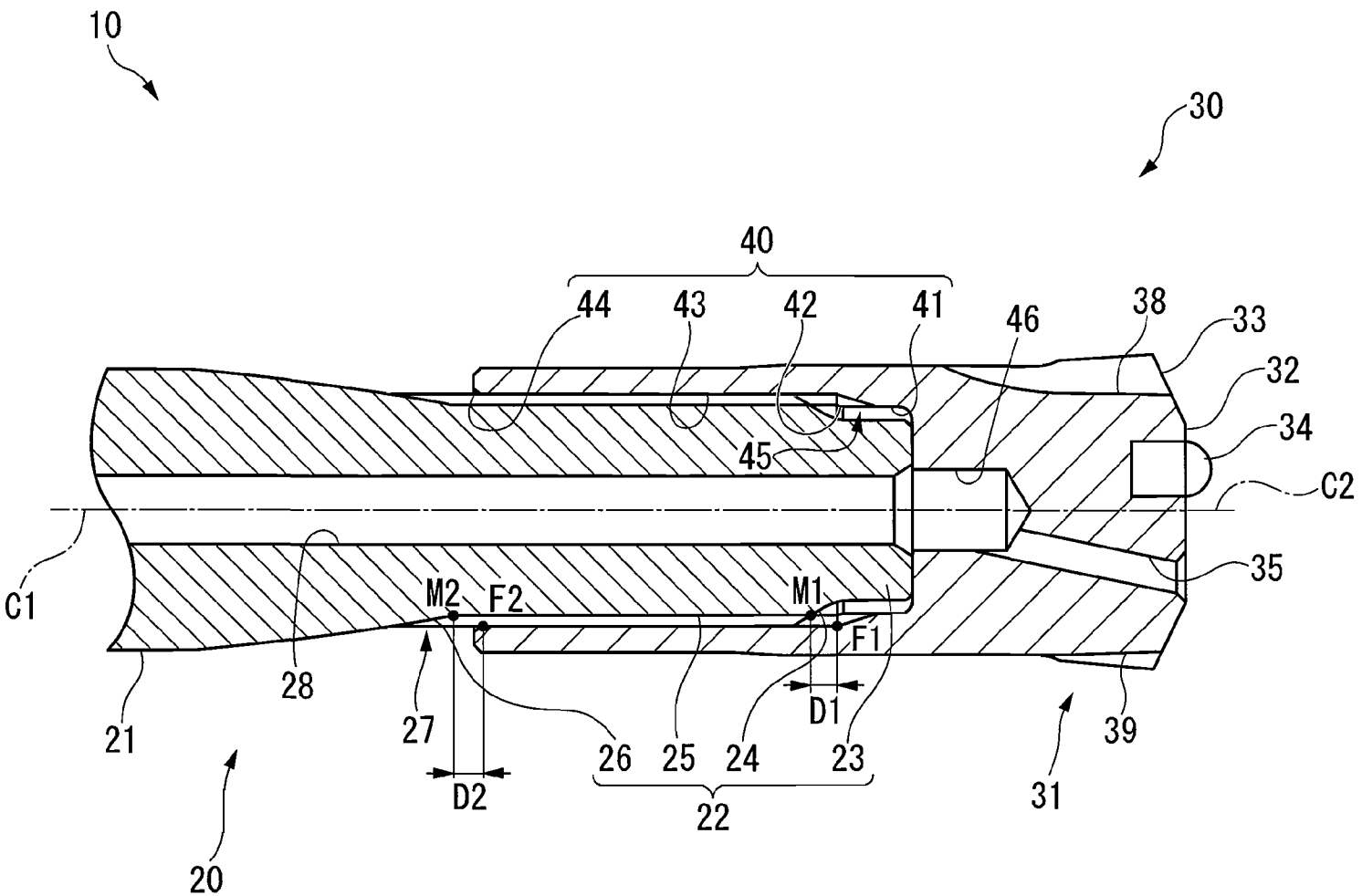
FIG. 1 is a side cross-sectional view showing a drilling tool of a first embodiment of the present invention.

10: drilling tool
20: drill rod
22: fitting portion
25: parallel male thread portion
26: second expanded-diameter portion
27: male thread ending portion
30: drill bit
40: fitting hole
42: first expanded-diameter hole
43: parallel female thread portion
45: female thread ending portion

BEST MODE FOR CARRYING OUT THE INVENTION

Figure 2:
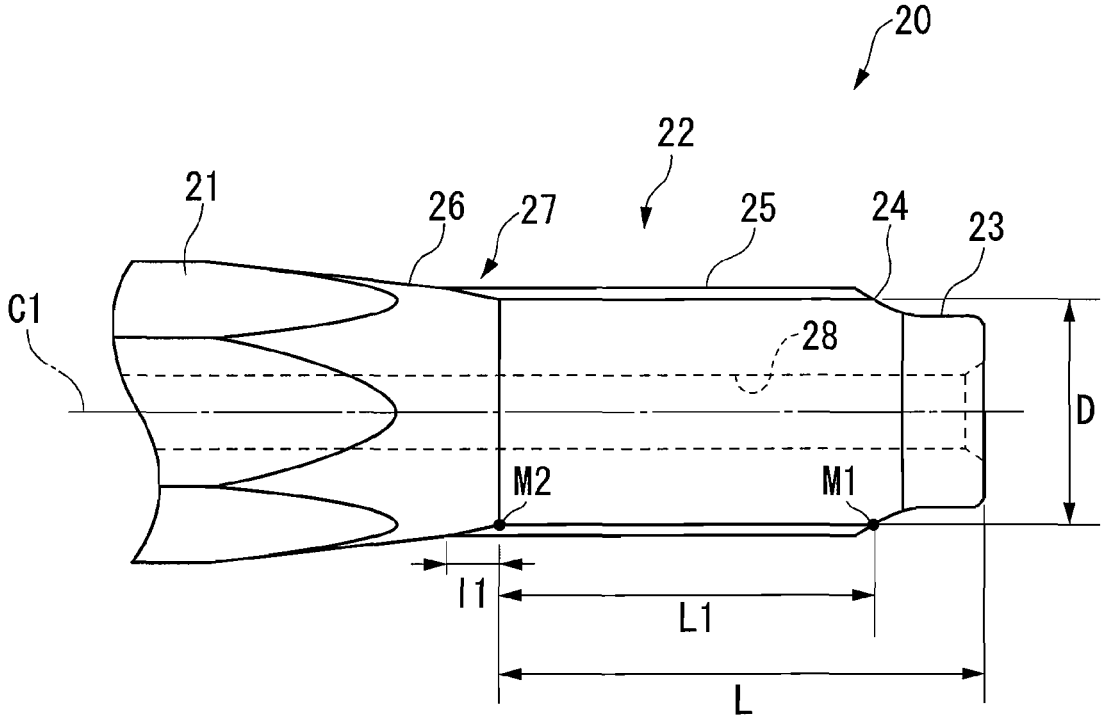
FIG. 2 is a side view showing a drill rod in the drilling tool shown in FIG. 1.
Figure 3:
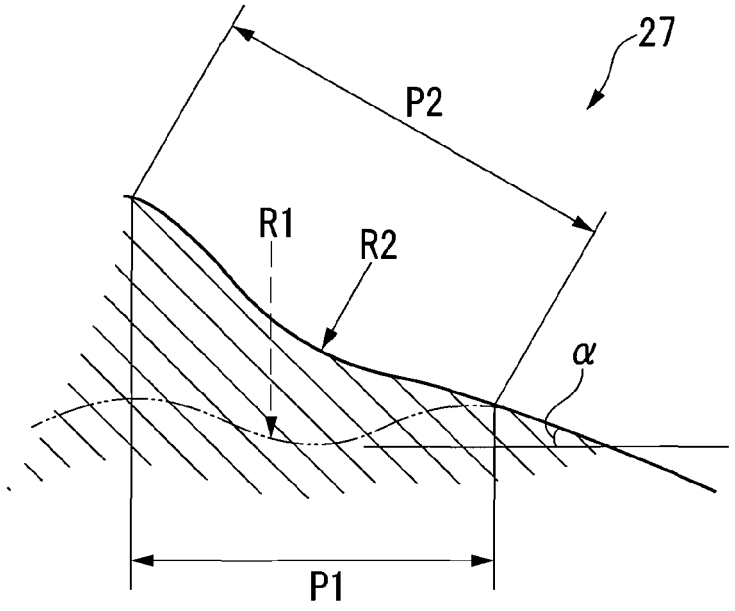
FIG. 3 is an explanatory view showing a male thread ending portion of the drill rod shown in FIG. 2.
Figure 4:
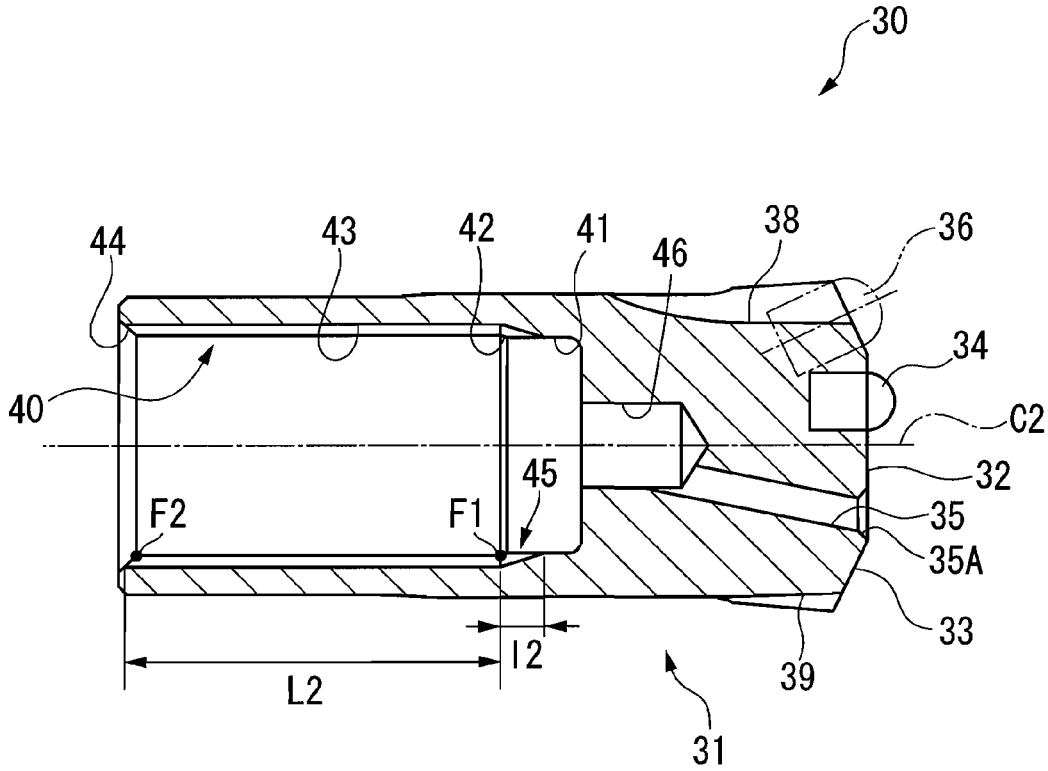
FIG. 4 is a side cross-sectional view showing a drill bit in the drilling tool shown in FIG. 1.
Figure 5:
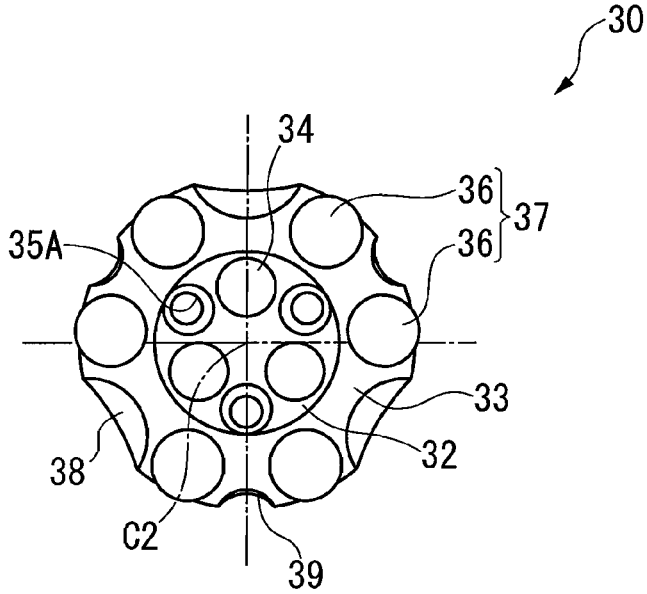
FIG. 5 is a diagram showing a distal of the drill bit shown in FIG. 4.

Below, embodiments of the present invention are explained referring to the attached drawings. FIG. 1 shows a drilling tool of a first embodiment of the present invention. FIG. 2 and FIG. 3 show a drill rod used in the drilling tool of the present embodiment. Also, FIG. 4 and FIG. 5 show a drill bit used in the drilling tool of the present embodiment.

The drilling tool 10 is mounted on drilling equipment to drill through bedrocks and other material to be drilled, and as shown in FIG. 1, employs a drill bit 30 which directly impacts the material to be drilled, and a drill rod 20 which supports this drill bit 30.

As shown in FIG. 2, the drill rod 20 employs a hexagonal-column rod body 21 extending along a first axial line C1, and a fitting portion 22 extending from a distal end of the rod body 21 (the right side in FIG. 2) along the first axial line C1.

The fitting portion 22 employs a small-diameter portion 23, formed in a distal end portion thereof and having the smallest diameter, and a parallel male thread portion 25 which is continuous with a proximal end of the small-diameter portion 23 with a first expanded-diameter portion 24 intervening; a proximal end of the parallel male thread portion 25 is continuous with the rod body 21 via a second expanded-diameter portion 26 intervening.

A male thread with a thread pitch P1 having a constant minor diameter is formed on an outer peripheral face of the parallel male thread portion 25. In this parallel male thread portion 25, the heights of thread ridges and depths of thread grooves are constant. A length L1 of the parallel male thread portion 25 along the direction of the first axial line C1 is set such that, relative to the thread pitch P1, $L1 \geqq 3.8 \times P1$. A length L along the direction of the first axial line C1 from a distal end face of the small-diameter portion 23 to a proximal end of the parallel male thread portion 25 is set such that, relative to the minor diameter D of the parallel male thread portion 25, $L \geqq 2.5 \times D$.

The proximal end of the male thread formed in the parallel male thread portion 25 is continuous with a male thread ending portion (incomplete thread) 27 formed at a distal end of the second expanded-diameter portion 26.

As shown in FIG. 3, the male thread ending portion 27 is formed such that the distance from the first axial line C1 in the thread ridge portions expands gradually as approaching toward the proximal end side. A radius of curvature R2 of thread groove portion in a cross-section containing the first axial line C1 in the male thread ending portion 27 is set to be larger than a radius of curvature R1 of the thread groove portion in a cross-section containing the first axial line C1 of the male thread formed in the parallel male thread portion 25. A length l1 in the direction of the first axial line C1 of the male thread ending portion 27 is equal to or less than the thread pitch P1. In FIG. 3, the thread shape of the male thread ending portion 27 is indicated by a solid line; and the incomplete thread portion shape, resulting when the parallel male thread portion 25 is ended without expanding the diameter, is indicated by a dashed line.

In the present embodiment, machining of the male thread was performed as follows. In a state in which a cutting tool was fixed in place, by moving the fitting portion 22 in the direction of the first axial line C1 at a rate of one pitch interval during one rotation, a male thread of thread pitch P1 was formed on the outer peripheral face of the fitting portion 22 (parallel male thread portion 25). The male thread ending portion 27 of the second expanded-diameter portion 26 was formed by gradually retracting the cutting tool to move the ending portion and expanded-diameter portion away from the first axial line C1.

By forming the male thread ending portion 27 in this way, the radius of curvature R2 of thread grooves formed in the second expanded-diameter portion 26 in a cross-section containing the first axial line C1 is greater than the radius of curvature R1 of thread grooves formed in the parallel male thread portion 25 in a cross-section containing the first axial line C1. That is, if a is the angle made by the second expanded-diameter portion 26 with the parallel male thread portion 25, then the pitch P2 along the taper face in the second expanded-diameter portion 26 relative to the pitch P1 in the parallel male thread portion 25 is equal to P1/cos α, which is large, so that the radius of curvature R2 of the thread groove is also large.

The fitting portion 22 of the drill rod 20 is formed such that, including the thread groove portions of the male threads formed on the above-described parallel male thread portion 25 and on the male thread ending portion 27, the minimum distance from the first axial line C1 in a cross-section perpendicular to the first axial line C1 is not smaller on the proximal end side than on the distal end side.

A fluid supply hole 28 is formed in the drill rod 20, extending along the first axial line C1 and opening in the distal end face of the drill rod 20.

As shown in FIG. 4 and FIG. 5, the drill bit 30 is formed with the outer shape substantially as a circular column shape; the distal end portion (on the right in FIG. 4) is a cutting-edge portion 31, which directly impacts the bedrock or other material to be drilled, and breaks up the material to be drilled. The cutting-edge portion 31 is formed such that as approaching toward the distal end, the outer diameter gradually increases. The distal end face of the cutting-edge portion 31 is provided with a central circular face 32 orthogonal to the second axial line C2 of the drill bit 30, and a ring-shape face 33 continuous with the outer periphery of the central circular face 32 and slightly inclined in the radial outside and proximal direction.

A plurality of circular column-shape button tips 34 in which the distal ends thereof protrude in hemispherical shape and which is formed from a hard material such as a cemented carbide or the like is embedded in the central circular face 32. Further, in the central circular face 32 are formed a plurality of openings 35A of fluid discharge holes 35 which communicate with a fitting hole 40, described below. In the present embodiment, as shown in FIG. 5, three button tips 34 are arranged at equal intervals in the circumferential direction (at 120° intervals), and in addition three openings 35A are arranged at equal intervals in the circumferential direction (120° intervals). The button tips 34 and the openings 35A are positioned in alternation in the circumferential direction.

In the ring-shape face 33 are embedded with a plurality of circular column-shape large-diameter button tips 36 formed from a hard material such as a cemented carbide or the like in which the distal ends thereof protrude in a hemispherical shape with outer diameters larger than those of the button tips 34 which are embedded in the central circular face 32. The axial lines of the circular columns of these large-diameter button tips 36 intersect the ring-shape face 33. That is, these large-diameter button tips 36 are positioned so that hemispherical faces thereof face the distal end of the drill bit 30 and outward in the radial direction.

In the present embodiment, as shown in FIG. 5, three pairs of large-diameter button tip pairs 37 including two large-diameter button tips 36 as one set are positioned at equal intervals in the circumferential direction.

Between these large-diameter button tip pairs 37 are formed first drill waste discharge grooves 38, which are depressed inward the radial direction and extend from the distal end toward the proximal end. Between the two large-diameter button tips 36 which form each large-diameter button tip pair 37 are formed second drill waste discharge grooves 39 shallower than the first drill waste discharge grooves 38. In the present embodiment, three first drill waste discharge grooves 38 are positioned at equal intervals in the circumferential direction (120° intervals), and three second drill waste discharge grooves 39 are positioned at equal intervals in the circumferential direction (120° intervals), with the first drill waste discharge grooves 38 and the second drill waste discharge grooves 39 alternately positioned in the circumferential direction.

In the drill bit 30, a fitting hole 40 which opens toward the proximal end (the left side in FIG. 4) and extends along the second axial line C2 is formed.

The fitting hole 40 includes: a small-diameter hole 41 formed at the distal end thereof; a first expanded-diameter hole 42 which is communicated with the proximal end of the small-diameter hole 41; a parallel female thread portion 43 which is continuous with the proximal end of the first expanded-diameter hole 42; and a second expanded-diameter hole 44 which is continuous with the proximal end of the parallel female thread portion 43. The fitting hole 40 opens at the proximal end of the drill bit 30.

A female thread with constant minor diameter and thread pitch P1 is formed in the inner peripheral face of the parallel female thread portion 43. A length along the direction of the first axial line C1 of the parallel female thread portion 43 is L2. In the parallel female thread portion 43, the heights of thread ridges and the depths of thread grooves are constant.

The distal end of the female thread formed in the parallel female thread portion 43 is continuous with a female thread ending portion 45, formed from the first expanded-diameter hole 42 to the small-diameter hole 41.

The female thread ending portion 45 is formed such that the distance from the second axial line C2 at the thread groove portion gradually decreases as approaching toward the distal end. The radius of curvature of thread groove portion in the female thread ending portion 45, in a cross-section containing the second axial line C2, is set so as to be larger than the radius of curvature of thread groove portion of the female thread formed in the parallel female thread portion 43, in a cross-section containing the second axial line C2. A length l2 along the direction of the second axial line C2 of the female thread ending portion 45 is equal to or less than the thread pitch P1.

In the drill bit 30, the fitting hole 40 is formed such that the maximum distance from the second axial line C2 in a cross-section perpendicular to the second axial line C2, including the thread groove portions of the female thread formed in the above-described parallel female thread portion 43 and the female thread ending portion 45, is not smaller on the proximal end side than on the distal end side.

On the distal end of the small-diameter hole 41, a communication hole 46 is provided, extending along the second axial line C2 and communicating with the fluid discharge holes 35.

By screwing the drill rod 20 and the drill bit 30 configured in this way, the drilling tool 10 of the present embodiment is configured.

By inserting the fitting portion 22 of the drill rod 20 into the fitting hole 40 of the drill bit 30, and screwing the parallel female thread portion 43 with the parallel male thread portion 25, the drill rod 20 and the drill bit 30 are connected such that the first axial line C1 of the drill rod 20 and the second axial line C2 of the drill bit 30 coincide. The distal end face of the small-diameter portion 23 of the drill rod 20 is in contact with the bottom face of the small-diameter hole 41 of the drill bit 30, and the fluid supply hole 28 and the communication hole 46 are connected.

In the drilling tool 10, in a state in which the drill rod 20 and the drill bit 30 are screwed together, and the distal end face of the small-diameter portion 23 of the drill rod 20 is in contact with the bottom face of the small-diameter hole 41 of the drill bit 30, a distance D1 along the direction of the first axial line C1 (the second axial line C2) between a distal end M1 of the parallel male thread portion 25 and a proximal end F1 of the female thread ending portion 45 is set so as to be larger than a distance D2 along the direction of the first axial line C1 (the second axial line C2) between a distal end M2 of the male thread ending portion 27 and a proximal end F2 of the parallel female thread portion 43, as shown in FIG. 1.

In the present embodiment, the hardness of the drill rod 20 is set higher than the hardness of the drill bit 30, and the difference in hardnesses is equal to or greater than 6 HRC points.

The drilling tool 10 configured in this way is mounted on a drilling equipment (not shown) at the proximal end side of the drill rod 20, driven by a striking device provided in the drilling equipment, applied a striking force and thrust force while the drill rod 20 being rotated about the first axial line C1. The rotation force, the striking force, and the thrust force are transmitted from the drill rod 20 to the drill bit 30, and the drill bit 30 impacts the material to be drilled such as the bedrock or the like while rotating about the second axial line C2. In this way, the material to be drilled is crushed and drilled by the button tips 34 and the large-diameter button tips 36, formed from a hard material such as cemented carbide or the like embedded in the distal end portion of the drill bit 30.

At this time, fluid supplied from the drilling equipment to the fluid supply hole 28 passes through the communication hole 46 and the fluid discharge holes 35, and is discharged from the openings 35A in the distal end of the drill bit 30; thereby drilling waste being discharged to the outside via the first drill waste discharge grooves 38 and the second drill waste discharge grooves 39.

As a result of application of a thrust force to the drill bit 30 while repeatedly causing impact with the material to be drilled, a reaction force load due to impacts is applied to the drill bit 30 and the drill rod 20.

According to the drilling tool 10 of the present embodiment, the fitting portion 22 of the drill rod 20 is formed such that the minimum distance from the first axial line C1 in a cross-section perpendicular to the first axial line C1 is not smaller on the proximal end side compared with the distal end side, so that an adequate external diameter dimension can be secured in the proximal end portion of the drill rod 20 which is subjected to large bending stresses during drilling. Further, a relief portion which gives rise to inadequate rigidity is not formed, so that breakage of the drill rod 20 due to such bending stresses can be prevented.

Further, the fitting hole 40 of the drill bit 30 is formed such that the maximum distance from the second axial line C2 to the inner face of the fitting hole 40 in a cross-section perpendicular to the second axial line C2 is not smaller on the proximal end side compared with the distal end side. Hence an adequate wall thickness can be secured in the distal end portion of the drill bit 30, which is subjected to the largest loads in the drill bit 30 during drilling. Further, a relief portion which gives rise to inadequate rigidity is not formed, so that damage to the drill bit 30 due to the load can be prevented.

According to the present embodiment, rigidity of the drill rod 20 and the drill bit 30 is secured, so that even when loads are increased due to an increased drilling speed of the drilling tool 10, breakage of and damage to the drill rod 20 and the drill bit 30 can be prevented, and drilling tasks can be performed efficiently.

Further, the drill rod 20 and the drill bit 30 are connected by screwing of a parallel male thread portion 25 with a parallel female thread portion 43, rather than using taper threads, so that even when forces act to cause separation of the drill bit 30 and the drill rod 20 as a result of shocks during drilling, the drill bit 30 and the drill rod 20 can be prevented from being separated easily. Also, female threads and male threads which are not tapered can easily be machined, so that the drill bit 30 and the drill rod 20 can be manufactured at low cost.

In the drill rod 20, the male thread ending portion 27 is formed on the second expanded-diameter portion 26, so that an adequate outer-diameter dimension of the male thread ending portion 27 can be secured, and rigidity of the drill rod 20 can be further improved.

Also, the radius of curvature R2 of thread groove portion in the male thread ending portion 27 is larger than the radius of curvature R1 of thread groove portion in the male threads formed in the parallel male thread portion 25, so that the cutout portion in the male thread ending portion 27 can be made small (the wall thickness can be made large), stress concentration can be reduced in the male thread ending portion 27, and the rigidity of the drill rod 20 can be reliably improved.

Further, the length l1 of the male thread ending portion 27 along the direction of the first axial line C1 is made equal to or less than the thread pitch P1, so that the male thread ending portion 27 which does not contribute to screwing of threads is not made longer than necessary, and rigidity of the drill rod 20 can be further improved.

Further, the length L1 of the parallel male thread portion 25 along the direction of the first axial line C1, relative to the pitch P1, is set such that $L1 \geqq 3.80 \times P1$, so that an adequate number of thread ridges can be secured in the parallel male thread portion 25, and the load acting on each thread ridge can be suppressed. Hence early wearing of threads can be reduced and stress concentration due to the tightening torque can be distributed in the parallel male thread portion 25, and the lifetime of the drill rod 20 can be extended.

Further, the length L from the distal end face of the fitting portion 20 to the proximal end of the parallel male thread portion 25 along the direction of the first axial line C1 is set, relative to the minor diameter D in the parallel male thread portion 25, such that $L \leqq 2.5 \times D$, so that the bending stress which is applied on the thread groove portion at the proximal end of the parallel male thread portion 25 can be reduced, and breakage in the parallel male thread portion 25 can be prevented.

In the drill bit 30, the female thread ending portion 45 is formed from the first expanded-diameter hole 42 to the small-diameter hole 41, so that an adequate wall thickness for the female thread ending portion 45 can be secured, and the rigidity of the drill bit 30 can be further improved.

Also, the radius of curvature of thread groove portion in the female thread ending portion 45 in a cross-section containing the second axial line C2 is larger than the radius of curvature of thread groove portion of the female thread formed in the parallel female thread portion 43 in a cross-section containing the second axial line C2, so that the cutout portion formed in the female thread ending portion 45 can be made small and the wall thickness can be increased, stress concentration in the female thread ending portion 45 can be reduced, and the rigidity of the drill bit 30 can be reliably improved.

Further, the length l2 of the female thread ending portion 45 along the direction of the second axial line C2 is equal to or less than the thread pitch P1, so that the female thread ending portion 45 which does not contribute to screwing of threads will not be longer than necessary, and rigidity of the drill bit 30 can be further improved.

In a state in which the drill rod 20 screwed with the drill bit 30, the distance D1 between the distal end M1 of the parallel male thread portion 25 and the proximal end F1 of the female thread ending portion 45 along the direction of the first axial line C1 (i.e., the direction of the second axial line C2) is larger than the distance D2 between the distal end M2 of the male thread ending portion 27 and the proximal end F2 of the parallel female thread portion 43 along the direction of the first axial line C1 (i.e., the direction of the second axial line C2), so that indentation of the proximal end of the parallel female thread portion 43 of the drill bit 30 with the male thread ending portion 27 occurs preferentially over indentation of the distal end of the parallel male thread portion 25 of the drill rod 20 with the female thread ending portion 45. Here, "indentation" means a state in which the thread surface is gouged by screwing of an incomplete thread portion.

Hence the indentation of the parallel male thread portion 25 at the distal end of the drill rod 20 is prevented, and the lifetime of the drill rod 20 can be further extended. Also, even when thread indentation occurs, the location of indentation is in the vicinity of the opening of the fitting hole 40, so separation of the drill rod 20 and the drill bit 30 and other measures can be performed comparatively easily. Further, in the present embodiment, the hardness of the drill rod 20 is set to the value higher than the hardness of the drill bit 30 by 6 HRC points or more, so that damage to the parallel male thread portion 25 (i.e., damage to the drill rod 20) due to indentation can be reliably prevented.

Figure 6:
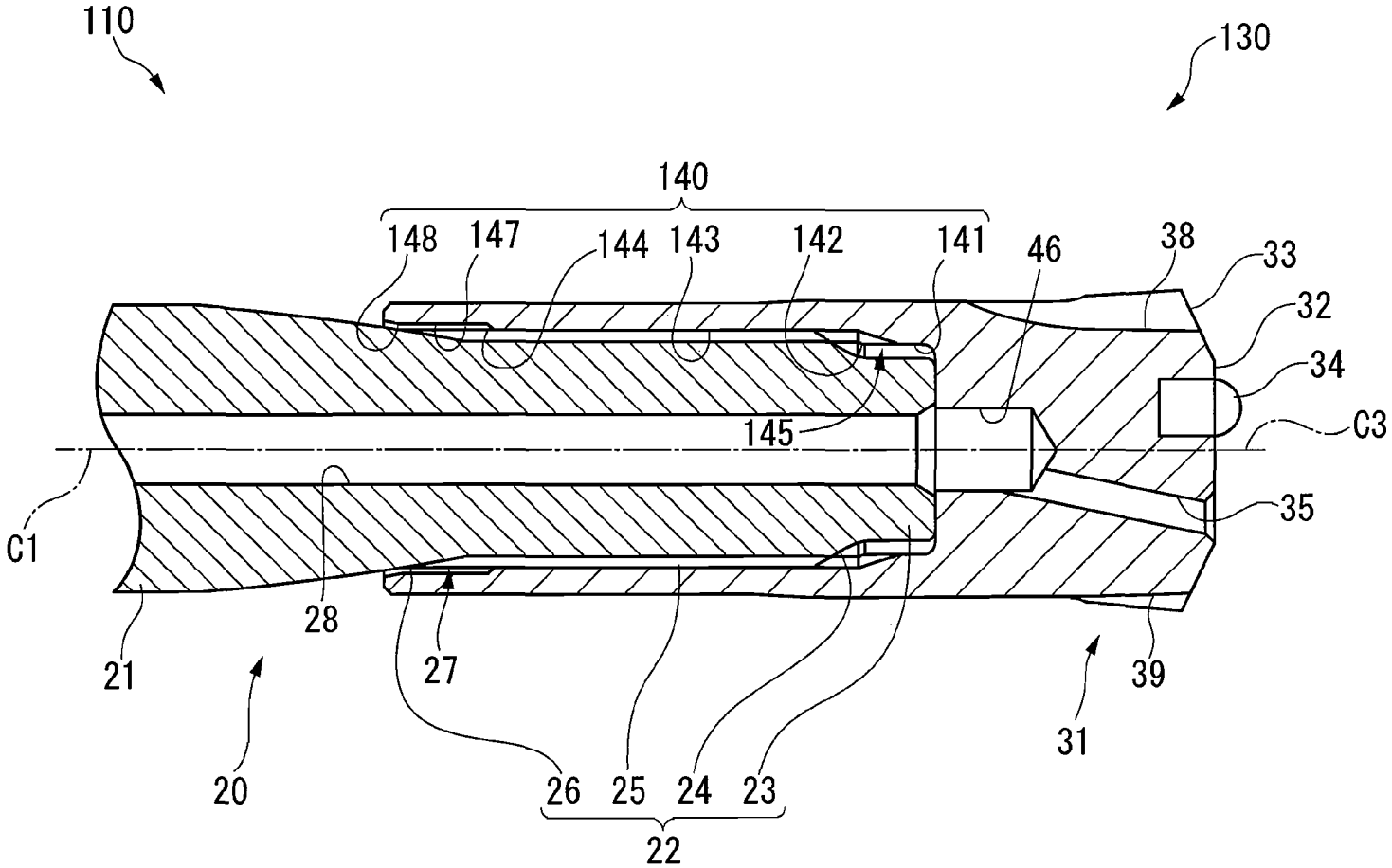
FIG. 6 is a side cross-sectional view of a drilling tool of a second embodiment of the present invention.
Figure 7:
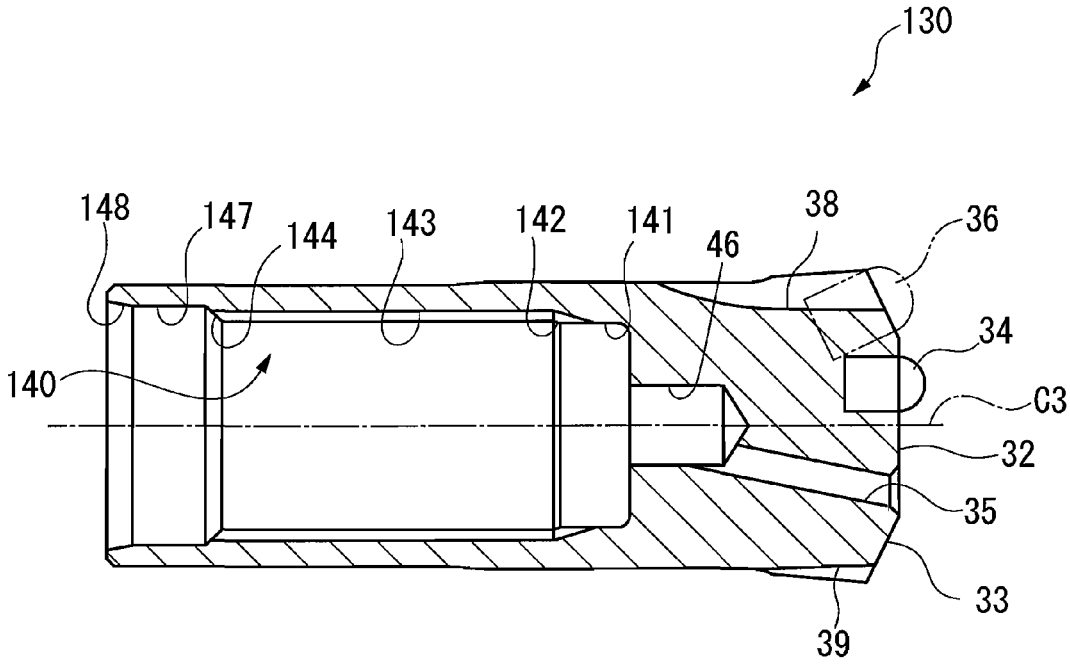
FIG. 7 is a side cross-sectional view showing a drill bit in the drilling tool shown in FIG. 6.

Next, a drilling tool 110 of a second embodiment of the present invention is explained, referring to FIG. 6 through FIG. 7. Portions which are common to the first embodiment are assigned the same symbols.

In the drilling tool 110 of the second embodiment, the drill rod 20 is the same as in the first embodiment, but a drill bit 130 is different. FIG. 6 shows the drilling tool 110 of the second embodiment. FIG. 7 shows the drill bit 130 employed in the drilling tool 110.

In the drill bit 130, a fitting hole 140 which opens directed toward the proximal end (the left side in FIG. 6) and extends along a second axial line C3 is formed.

The fitting hole 140 has: a small-diameter hole 141 formed at the distal end thereof; a first expanded-diameter hole 142 which is continuous with the proximal end of the small-diameter hole 141; a parallel female thread portion 143 which is continuous with the proximal end of the first expanded-diameter hole 142; a second expanded-diameter hole 144 which is continuous with the proximal end of the parallel female thread portion 143; a fixed-diameter hole 147 having constant inner diameter formed at the further proximal end of the second expanded-diameter hole 144; and a third expanded-diameter hole 148 which is formed at the proximal end of the fixed-diameter hole 147, and the fitting hole 140 opens in the proximal end face of the drill bit 130. The distal end of the female thread formed in the parallel female thread portion 143 is continuous with a female thread ending portion 145 formed from the first expanded-diameter hole 142 to the small-diameter hole 141.

The angle at which the inner peripheral face of the third expanding-diameter hole 148 expands as approaching toward the proximal end is equal to the angle at which the outer peripheral face of the second expanded-diameter portion 26 of the drill rod 20 expands as approaching toward the proximal end.

The drill bit 130 is screwed with the drill rod 20 to form the drilling tool 110.

When the first axial line C1 of the drill rod 20 and the second axial line C3 of the drill bit 130 coincide, the inner peripheral face of the third expanded-diameter hole 148 of the drill bit 130 and the outer peripheral face of the second expanded-diameter portion 26 of the drill rod 20 are positioned at a distance, as shown in FIG. 6.

In the drilling tool 110 formed as described above, bending stress is exerted on the drill rod 20 by the load on the drilling tool 110, and when there is displacement such that the first axial line C1 of the drill rod 20 and the second axial line C3 of the drill bit 130 intersect, the inner peripheral face of the third expanded-diameter hole 148 of the drill bit 130 comes into contact with the outer peripheral face of the second expanded-diameter portion 26 of the drill rod 20, and this bending stress can be received where the external diameter is large on the proximal end side of the drill rod 20 and rigidity is high. Hence breakage of the drill rod 20 and damage to threads due to bending stresses can be reliably prevented.

In the above, the drilling tools of embodiments of the present invention have been explained; but the invention is not limited to these, and various appropriate modifications can be made, without departing from the technical concept of the present invention.

For example, the shape of the fitting portion is not limited to that of these embodiments, but need only be a shape such that the minimum distance from the first axial line C1 in a cross-section perpendicular to the first axial line C1 is not smaller on the proximal end side than on the distal end side.

Similarly, the shape of the fitting hole is not limited to those of the embodiments, but need only be such that the maximum distance from the second axial line C2 or C3 in a cross-section perpendicular to the second axial line C2 or C3 is not smaller on the proximal end side than on the distal end side.

The rod body 21 of the drill rod 20 having a hexagonal column shape was explained; but the rod body is not limited to this shape, and the rod body may have a circular column shape.

The sizes, number, and placement of the button tips and the large-diameter button tips positioned on the distal end face of the drill bit are also not limited to those of the embodiments, and it is preferable that these parameters be set appropriately, taking into consideration the outer diameter of the drilling tool, the material to be drilled, and the like.

The drill rod explained in these embodiments may also be screwed with another drill bit to form the drilling tool. In this case also, rigidity of the drill rod is secured, so that the drilling speed can be raised and drilling tasks can be performed efficiently, and moreover the occurrence of breakage accidents can be reduced.

Examples

Below, the results of studies regarding the length L1 of the parallel male thread portion in the present invention are described.

When considering the rigidity of a drill rod, it is better to have a short length L1 for the parallel male thread portion which cuts out the outer peripheral face of the drill rod. In particular, a portion at a long distance from the distal end portion which is loaded with a bending load during drilling and has a small outer diameter undergoes the largest stresses, possibly resulting in breakage, and so it is preferable that the parallel male thread portion in which thread grooves be formed be short.

On the other hand, loads in the axial line direction applied due to the rotation force and thrust force act on the thread ridge portions. Hence when considering the load applied per thread ridge, it is preferable that there be numerous thread ridges and that the length L1 of the parallel male thread portion be longer.

FEM analyses were performed on the length of the parallel male thread portion and on the maximum stresses occurring due to axial direction loads applied to thread ridge portions and bending loads applied to the drill rod.

In the FEM analyses, two conditions were used, with the length L1 of the parallel male thread portion set to 34 mm and 49 mm. Further, the thread pitch P1 was 12.7 mm. The maximum stresses when an axial-direction load and a bending load were applied to these models were both calculated, and a linear approximation was applied to the results.

Figure 8:
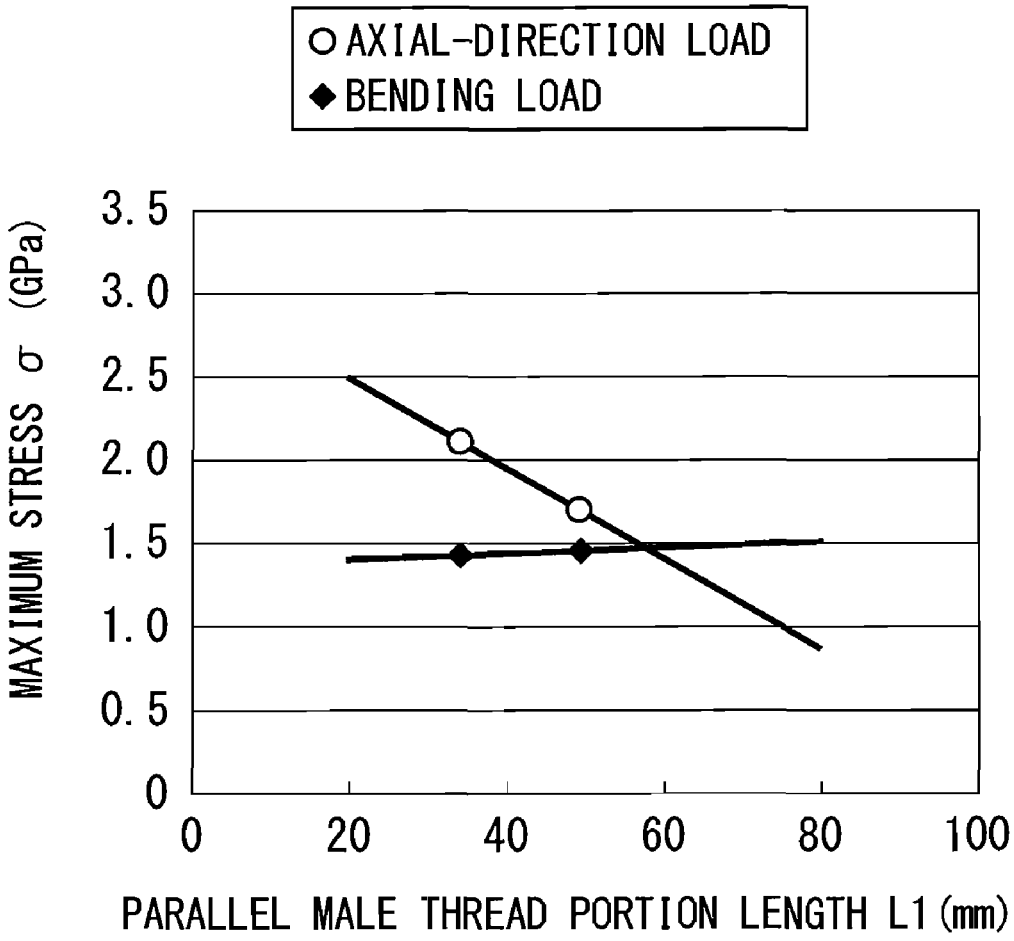
FIG. 8 is a view showing results of FEM analysis.

Analysis results appear in FIG. 8.

As shown in FIG. 8, when an axial-direction load is applied, as the parallel male thread length L1 increases the maximum stress falls rapidly. On the other hand, when a bending load is applied, the maximum stress rises gradually with increasing parallel male thread length L1. That is, with respect to the length L1 of the parallel male thread portion, the stress due to the axial-direction loads is affected more than is the stress due to the bending loads.

From these analysis results, upon considering the stresses due to the bending load and the stresses due to the axial-direction loads, it was found to be preferable, when the thread pitch P1 is 12.7 mm, to set the parallel male thread length L1 to 48.26 mm (3.8×P1) or greater.

In the above, preferred embodiments of the present invention have been explained; but the present invention is not limited to these embodiments. Various additions, omissions, substitutions, and other modifications are possible, without deviating from the gist of the present invention. The present invention is not limited by the foregoing explanations, but is limited solely by the scope of the attached claims.

INDUSTRIAL APPLICABILITY

According to the present invention, a drill rod, a drill bit, and a drilling tool can be provided, such that high rigidity of the drill rod and the drill bit can be secured, so that the drilling speed can be increased and drilling tasks can be performed efficiently, and in addition, it is possible to prevent easy detachment of the drill bit and the drill rod due to shocks during drilling.

The invention claimed is:

1. A drill rod comprising a fitting portion which protrudes toward a distal end of the drill rod and extends along a first axial line, wherein the fitting portion includes:

a parallel male thread portion in which a minimum distance from the first axial line in a cross-section perpendicular to the first axial line is constant; and a male thread ending portion which is continuous with a proximal end of the parallel male thread portion, and in which the minimum distance increases approaching a proximal end thereof;

the fitting portion is formed such that the minimum distance does not decrease approaching a proximal end from a distal end thereof;

the proximal end of the male thread ending portion is positioned on a face where a distance from the first axial line gradually increases approaching the proximal end of the male thread ending portion from the parallel male thread portion; and a radius of curvature of a thread groove portion in the male thread ending portion, in a cross-section including the first axial line, is larger than a radius of curvature of a thread groove portion of a male thread formed in the parallel male thread portion, in a cross-section including the first axial line.

2. A drill bit comprising a fitting hole which is opened toward a proximal end of the drill bit and extends along a second axial line, wherein the fitting hole includes:

a parallel female thread portion in which a maximum distance from the second axial line in a cross-section perpendicular to the second axial line is constant; and a female thread ending portion which is continuous with a distal end of the parallel female thread portion, in which the maximum distance decreases approaching a distal end thereof;

the fitting hole is formed such that the maximum distance does not decrease approaching the proximal end from a distal end thereof;

the distal end of the female thread ending portion is positioned on a face where a distance from the second axial line is smaller than that for the parallel female thread portion; and a radius of curvature of a thread groove portion in the female thread ending portion, in a cross-section including the second axial line, is larger than a radius of curvature of a thread groove portion of a female thread formed in the parallel female thread portion, in a cross-section including the second axial line.

3. A drilling tool comprising the drill rod according to claim 1 or the drill bit according to claim 2, wherein the drilling tool is configured by screwing the parallel male thread portion of the drill rod with the parallel female thread portion of the drill bit.

4. The drilling tool according to claim 3, further comprising:

a first inclined face formed on the proximal end portion of the fitting portion of the drill rod in which a distance from the first axial line in a cross-section perpendicular to the first axial line gradually increases approaching a proximal end of the drill rod; and a second inclined face formed on a proximal end portion of the fitting hole of the drill bit in which a distance from the second axial line in a cross-section perpendicular to the second axial line gradually increases approaching the proximal end, wherein when the first axial line of the fitting portion and the second axial line of the fitting hole coincide, the first inclined face and the second inclined face are separated, while when the first axial line and the second axial line are displaced so as not to coincide, the first inclined face and the second inclined face are in mutual contact.

5. A drill rod comprising a fitting portion which protrudes toward a distal end of the drill rod and extends along a first axial line, wherein the fitting portion includes:

a parallel male thread portion in which a minimum distance from the first axial line in a cross-section perpendicular to the first axial line is constant; and a male thread ending portion which is continuous with a proximal end of the parallel male thread portion, and in which the minimum distance increases approaching a proximal end thereof;

the fitting portion is formed such that the minimum distance does not decrease approaching a proximal end from a distal end thereof;

the proximal end of the male thread ending portion is positioned on a face where a distance from the first axial line gradually increases approaching the proximal end of the male thread ending portion from the parallel male thread portion; and a length of the male thread ending portion along the first axial line direction is equal to or less than a thread pitch of the parallel male thread portion.

6. A drill rod comprising a fitting portion which protrudes toward a distal end of the drill rod and extends along a first axial line, wherein the fitting portion includes:

a parallel male thread portion in which a minimum distance from the first axial line in a cross-section perpendicular to the first axial line is constant; and a male thread ending portion which is continuous with a proximal end of the parallel male thread portion, and in which the minimum distance increases approaching a proximal end thereof;

the fitting portion is formed such that the minimum distance does not decrease approaching a proximal end from a distal end thereof;

the proximal end of the male thread ending portion is positioned on a face where a distance from the first axial line gradually increases approaching the proximal end of the male thread ending portion from the parallel male thread portion;

a length (L) along the first axial line direction from a distal end face of the fitting portion to the proximal end of the parallel male thread portion, with respect to a diameter (D) of the thread groove of the parallel male thread portion, satisfies $L \leqq 2.5 \times D$; and a length ($L1$) along the first axial line direction of the parallel male thread portion, with respect to a thread pitch (P) of the parallel male thread portion, satisfies $L1 \geqq 3.8 \times P$.

7. A drill bit comprising a fitting hole which is opened toward a proximal end of the drill bit and extends along a second axial line, wherein the fitting hole includes:

a parallel female thread portion in which a maximum distance from the second axial line in a cross-section perpendicular to the second axial line is constant; and a female thread ending portion which is continuous with a distal end of the parallel female thread portion, in which the maximum distance decreases approaching a distal end thereof;

the fitting hole is formed such that the maximum distance does not decrease approaching the proximal end from a distal end thereof;

the distal end of the female thread ending portion is positioned on a face where a distance from the second axial line is smaller than that for the parallel female thread portion; and a length of the female thread ending portion along the second axial line direction is equal to or less than a thread pitch of the parallel female thread portion.

8. A drilling tool comprising a drill rod and a drill bit, wherein the drill rod comprises a fitting portion which protrudes toward a distal end of the drill rod and extends along a first axial line;

the fitting portion includes:

a parallel male thread portion in which a minimum distance from the first axial line in a cross-section perpendicular to the first axial line is constant; and a male thread ending portion which is continuous with a proximal end of the parallel male thread portion, and in which the minimum distance increases approaching a proximal end thereof;

the fitting portion is formed such that the minimum distance does not decrease approaching a proximal end from a distal end thereof;

the proximal end of the male thread ending portion is positioned on a face where a distance from the first axial line gradually increases approaching the proximal end of the male thread ending portion from the parallel male thread portion;

the drill bit comprises a fitting hole which is opened toward a proximal end of the drill bit and extends along a second axial line;

the fitting hole includes:

a parallel female thread portion in which a maximum distance from the second axial line in a cross-section perpendicular to the second axial line is constant; and a female thread ending portion which is continuous with a distal end of the parallel female thread portion, in which the maximum distance decreases approaching a distal end thereof;

the fitting hole is formed such that the maximum distance does not decrease approaching the proximal end from a distal end thereof;

the distal end of the female thread ending portion is positioned on a face where a distance from the second axial line is smaller than that for the parallel female thread portion;

the drilling tool is configured by screwing the parallel male thread portion of the drill rod with the parallel female thread portion of the drill bit; and in a state in which the drill rod and the drill bit are screwed together, a distance along the first axial line direction between a distal end of the parallel male thread portion and a proximal end of the female thread ending portion is greater than a distance along the first axial line direction between a distal end of the male thread ending portion and a proximal end of the parallel female thread portion.

* * * * *

UNITED STATES PATENT AND TRADEMARK OFFICE

CERTIFICATE OF CORRECTION

PATENT NO. : 7,942,216 B2
APPLICATION NO. : 12/092134
DATED : May 17, 2011
INVENTOR(S) : Masaya Hisada et al.

It is certified that error appears in the above-identified patent and that said Letters Patent is hereby corrected as shown below:

Title page 1 of the printed patent, paragraph (75) Inventors: Line 1-2:
"Masaya Hisada, Gifu-Ken (JP)" should be --Masaya Hisada, Anpachi-gun (JP)--;
"Masahiro Koizumi, Gunman-Ken (JP)" should be --Masahiro Koizumi, Takasaki-shi (JP)--

Signed and Sealed this
Twenty-third Day of August, 2011

David J. Kappos

David J. Kappos
*Director of the United States Patent and Trademark Office*